United States Patent [19]

Gray

[11] 4,360,401

[45] Nov. 23, 1982

[54] METHOD FOR MAKING ALUMINUM ALLOY LITHOGRAPHIC PLATES OR AL/CA LITHOGRAPHIC ALLOY

[75] Inventor: Alan Gray, Gerrards Cross, England

[73] Assignee: The British Aluminum Company Limited, London, England

[21] Appl. No.: 170,294

[22] Filed: Jul. 18, 1980

[30] Foreign Application Priority Data

Jul. 20, 1979 [GB] United Kingdom ..... 7925301

[51] Int. Cl.[3] ..... C23F 1/00; B41M 5/00

[52] U.S. Cl. ..... 156/665; 101/395; 101/459; 101/463.1; 156/659.1; 156/905; 252/79.5; 430/302

[58] Field of Search ..... 252/79.5; 156/654, 905, 156/665, 659.1; 134/41; 430/302–305; 101/395, 401, 453, 459, 463.1; 204/33, 129.1, 129.65

[56] References Cited

U.S. PATENT DOCUMENTS 3,220,899 11/1965 Leonard ..... 252/79.5 X 3,330,743 7/1967 Jestl et al. ..... 156/665 X

*Primary Examiner*—William A. Powell

*Attorney, Agent, or Firm*—Karl W. Flocks; Sheridan Neimark

[57] ABSTRACT

A method of making a lithographic plate by etching in an alkaline bath a sheet of an alloy of aluminium and 0.1% to 4.5% calcium. The alloy preferably contains up to 2.0% magnesium.

10 Claims, 15 Drawing Figures

Al 1% Ca - 1% Zn
ETCHED IN 4% NaOH

Al - 1% Ca ETCHED IN 4% NaOH

Al-1% Ca, 1% Zn ETCHED IN 4% NaOH

Al - 1% Ca ETCHED IN 4% NaOH

Al-45% Ca ETCHED IN 4% NaOH

Al - 1% Mn (BA 3003) ETCHED IN 4% NaOH

AL-4.5% CU ETCHED IN 4% NaOH
30
20
10
1·0
2·0
3·0
4·0
5·0
DEPTH (μM)

BA 3003 (AL - 1% Mn)
ETCHED IN 4% NaOH
30
20
10
1·0
2·0
3·0
4·0
5·0
DEPTH (μM)

BA 3003 ETCHED IN
NaOH + NaNO2

BA 1260 (99·6% PURE Al)
ETCHED IN NaOH

FIG. 5b BA 3003 ETCHED IN NaOH + $NaNO_2$

FIG. 6b BA 1260 (99.6% PURE Al) ETCHED IN NaOH

ARITH. MEAN PIT
DEPTH = 2·9 μm
60
50
40
30
20
10
2·5
5·0
7·5
10·0
12·5
DEPTH (μM)

METHOD FOR MAKING ALUMINUM ALLOY LITHOGRAPHIC PLATES OR AL/CA LITHOGRAPHIC ALLOY

BACKGROUND OF THE INVENTION

This invention relates to aluminium alloy lithographic plates.

Aluminium alloy lithographic plates may be used in the ungrained state for certain non-critical applications but are normally grained either electrochemically or mechanically to produce a roughened surface. This improves the water retentive properties of the plate surface and assists adhesion of a light sensitive coating. Electrochemical graining is usually carried out by applying an alternating potential to a sheet of aluminium alloy immersed in a dilute acid solution. It is often preceded by a light treatment in an alkaline solution, commonly a sodium hydroxide solution, to clean the sheet of residual rolling lubricant and detritus.

Electrochemical graining produces particularly good results but is expensive. When 'double sided' plates are required this involves extra cost.

Many attempts have been made to produce grained lithographic plates from aluminium and aluminium alloys by a simple chemical etching process in an alkaline solution. Such a process is commercially advantageous since it can be carried out by feeding strip material continuously through a suitable alkaline solution and automatically produces double sided plates. However using commercial purity aluminium or many previously proposed alloys the results have been poor compared with electrochemical graining and not capable of producing lithographic plates of high enough quality.

Applicants have considerable experience in alkaline etching of aluminium and many of its alloys for other purposes, such as architectural products, where coarser graining is acceptable. When commercial purity aluminium is etched in an alkaline solution the disolution process is under cathodic control (i.e.) the rate of reaction is largely controlled by the cathodic process which is exemplified by the rate of hydrogen evolution. It is known that the reaction rate can be improved markedly by the alloying additions of elements more electropositive than aluminium. The precise mechanism of operation is not fully understood but we believe that the intermetallic particles so produced facilitate the hydrogen evolution process and encourage pitting in the aluminium surrounding each intermetallic particle. Accordingly experiments have been conducted on aluminium alloys including iron, tin and manganese to accelerate the etching process. These elements produce an acceleration of the etching process but are difficult to introduce in a dense and uniform distribution and do not result in a sufficiently dense distribution of pits.

A further approach which may be used in conjunction with that described above is to make additions of elements more electronegative than aluminium and it is known that additions of magnesium result, after alkaline etching, in more uniformly and densely pitted surfaces. In particular additions of magnesium and silicon are known for architectural products and when etched provide a matt surface although this surface is too coarse for lithographic plates. Again the precise mechanism is not fully understood but we believe that the etching solution preferentially attacks the magnesium silicide intermetallic particles and then further preferentially attacks the aluminium within the pits so formed.

Alloys of aluminium and calcium have been known for many years but until recently they were little used and then mostly for cast products where good heat/-strength characteristics were desirable. More recently aluminium/calcium alloys with the calcium addition at or near the eutechtic have been used for their predictable superplastic properties. None of this previous use points to any benefit of adding calcium to aluminium to enhance alkaline etching characteristics. However we have found that certain alloys of aluminium and calcium are capable of being etched in alkaline solution to be usable as lithographic plates.

BRIEF SUMMARY OF THE INVENTION

Accordingly one aspect of the present invention provides a method of making a lithographic plate comprising subjecting at least one side of a sheet of an alloy containing 0.1% to 4.5% Ca; the remainder being aluminium together with normal impurities to an alkaline etching process until a dense, substantially uniform distribution of pits having an average depth ranging between 0.2 μm and 3.0 μm is produced on said side. Preferably the alloy contains up to 2.0% Mn and it may also contain up to 6.0% Zn.

The quantity of Ca is preferably 0.2% to 2.5% and advantageously 0.3% to 1.2% although when Mn is incorporated in the alloy the preferred Ca range is 0.2% to 2.5% with 0.05% to 2.0% Mn. Advantageously the Mn range is 0.1% to 1.5%.

The alloy may contain additional elements as follows and selected in any combination Fe 0.04% to 1.5%; Mg 0.01% to 5.0%; Si 0.03% to 1.5%; Cu 0.005% to 1.0%; and Cr 0.01% to 0.5%.

The alkaline etching solution may be produced by dissolving in water the hydroxides of alkali metals or ammonia and is preferably sodium hydroxide. The concentration of such solutions is between 20 and 270 g/l preferably 20 to 100 g/l and the etching temperature is between 15° C. and 100° C. preferably between 40° C. and 80° C. Application of the etching solution may be by immersion of the alloy in the solution or by spraying.

BRIEF DESCRIPTION OF DRAWINGS

The above and other aspects of the invention will now be described by way of example with reference to the accompanying drawings in which:

FIGS. 1*a* to 7*a* are graphs of pit depth against the number of pits with a given depth for a variety of alloys, FIGS. 1*b* to 7*b* show corresponding surface profile traces, and FIGS. 8*a, b* and *c* are diagrammatic representations of further surface profile traces.

DETAILED DESCRIPTION OF INVENTION

Figure 1A:
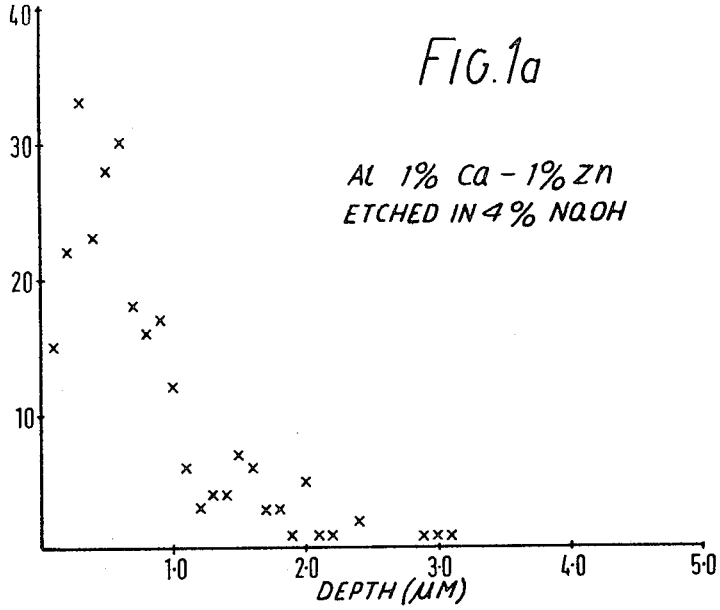

An alloy containing the desired calcium addition is produced by semi-continuous or continuous casting and hot and cold rolling to the required gauge. The metal sheet so produced can be grained to form a lithographic plate by immersion for 5 minutes in a solution of sodium hydroxide (50–100 g/l at 50°–70° C.). It will here be understood that the concentration and temperature of the solution may be selected to give the required etching rate. Using a 200 g/l NaOH solution at 80° C. a suitable grained surface can be produced in one minute while at 50° C. in 40 g/l NaOH a ten minute immersion is required. If desired sodium hydroxide to which an oxidising agent (to accelerate etching) has been added may be used. Such oxidising agents may be selected from alkali metal peroxides, persulphates, nitrites, nitrates, chlorates, perchlorates and chlorites. Fluorides may also be used to accelerate etching. The sodium hydroxide may also contain sequestrants, surfactants and antifoaming agents.

Sequestrants may be selected from salts of polyhydroxy carboxylic acids such as sodium gluconate, sorbitol or EDTA. Surfactants may be selected from fluoro or sodium - alkyl salts of sulphonic, carboxylic and phosphoric acids; long chain amines of primary, secondary and tertiary types and quaternary ammonium salts, compounds of ethylene oxide. Anti foaming agents may be organic silicone compounds, alkylglycol ether or alkyl sulphonates. Immersion produces double sided plates. The grained plate may then be cleaned of smut by immersion in nitric or phosphoric acids, washed and anodized. Depending on the type of plate to be produced a coating of light sensitive polymer may be applied 'in line' as is normal practice in the production of presensitised plates, or the light sensitive coating may be applied by the plate user.

Lithographic printing plates produced in this way show the following advantages. Graining to produce a surface comparable to or better than those produced by electrochemical graining can be achieved by a simple immersion or spray treatment in relatively inexpensive chemicals. No prior cleaning or degreasing is required before the graining process. The plate material may be grained on both surfaces simultaneously at no extra cost and is thus very suitable for the production of double sided plates. Mechanical properties of the plates may be more suitable than those of the existing plate alloys in that high strength is combined with good ductility. For example: Al-Ca alloy plates having a tensile strength of between 170 and 230 N/mm$^2$ give an elongation in the region of 6% while conventional lithographic plates having a strength of 150 N/mm$^2$ give an elongation in the region of 3%. Ductility may be further improved by the addition of Zn to the alloy, this having no detrimental effect on the strength properties and graining response. The following table 1 shows typical characteristics:

TABLE 1

| | Ultimate Tensile Strength (N/mm$^2$) | 0.2% Proof Strength (N/mm$^2$) | Elong |
|---|---|---|---|
| 1% Ca | 179 | 160 | 6.5 |
| 3% Ca | 222 | 173 | 6.0 |
| 4.5% Ca | 262 | 192 | 4.0 |
| 1% Ca 1% Zn | 180 | 159 | 7.0 |
| 3% Ca 1% Zn | 222 | 175 | 7.0 |
| 1% Ca 1.5% Mn | 239 | 210 | 5.0 |

Thus the addition of small amounts of Ca added to Al of normal purity provides an alloy in which the Ca is finely dispersed as intermetallic particles and when etched in a suitable alkaline solution these particles encourage fine-uniform pitting to provide a grained surface suitable for lithographic use. We have found that the addition of Mn to the binary alloy creates a structure in which the pits become deeper for the same etching proces and moreover the interior surfaces of the pits are micro-roughened. We do not know why this phenomenon occurs. The addition of Mn also improves the strength characteristics of the plate.

The following Table 2 gives mean and maximum pit depths for a number of alloys grained according to the present invention with the comparison of a commercial electrolytically etched plates.

TABLE 2

Figure 2A:
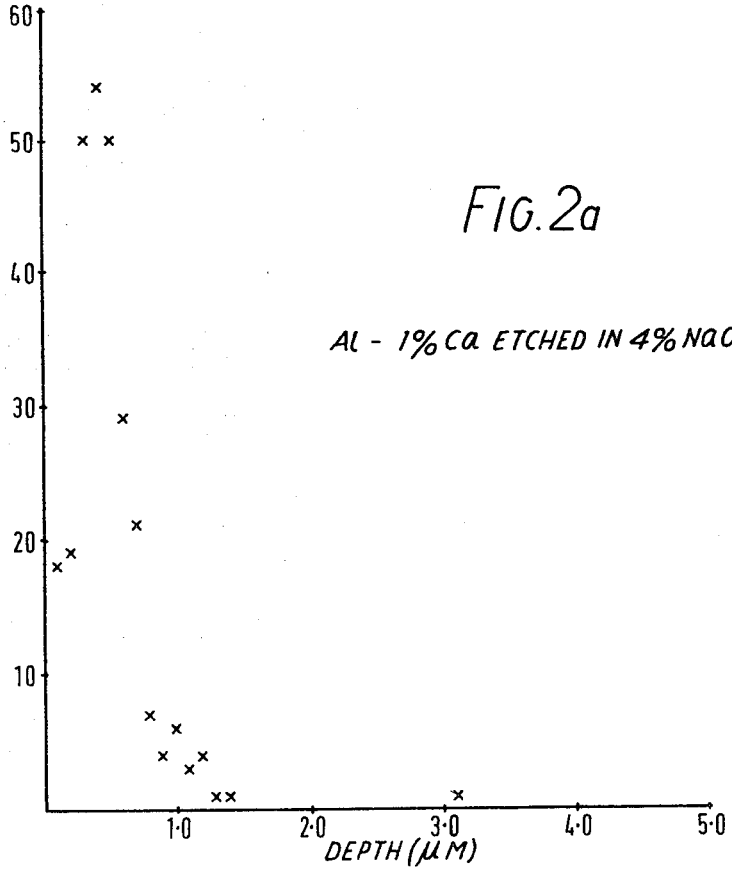
Figure 1B:
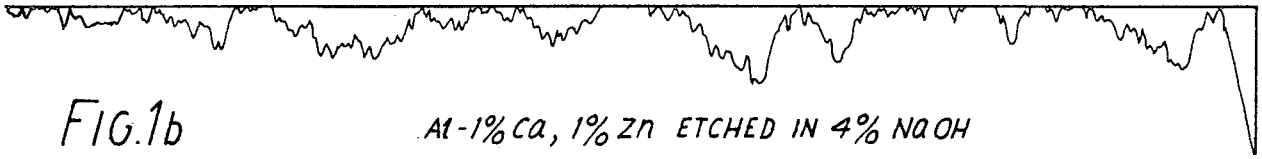
Figure 2B:
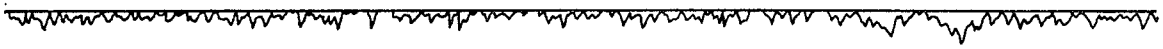
Figure 3B:
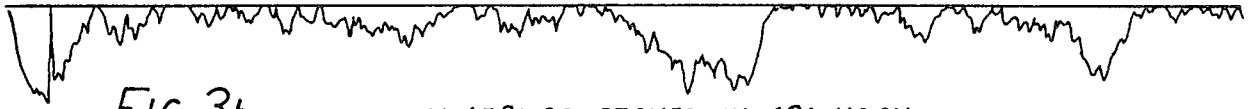
Figure 4B:
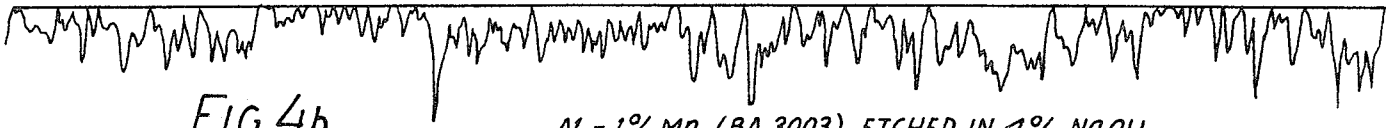
Figure 3A:
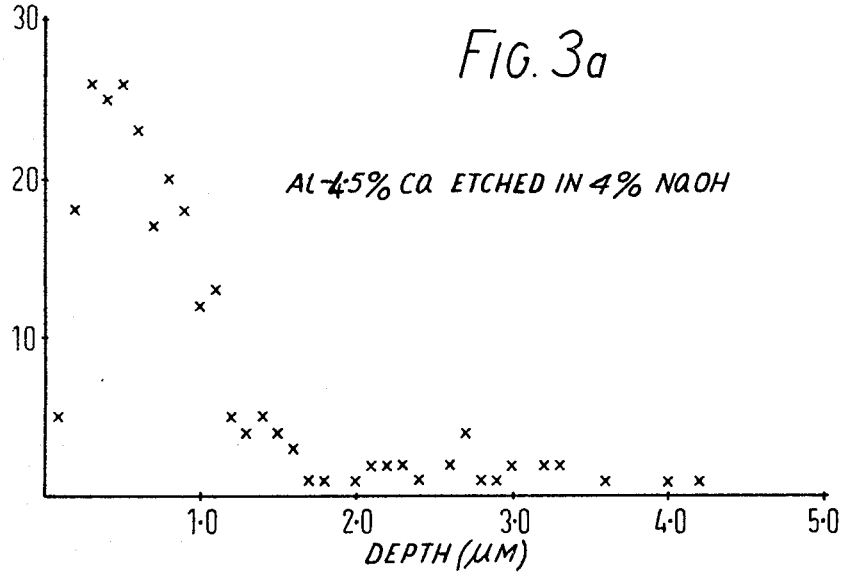
Figure 4A:
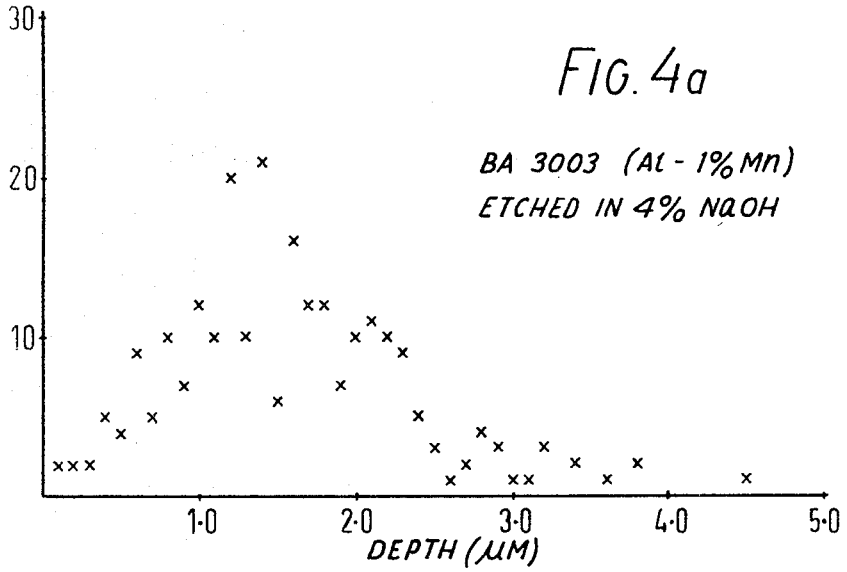
Figure 5A:
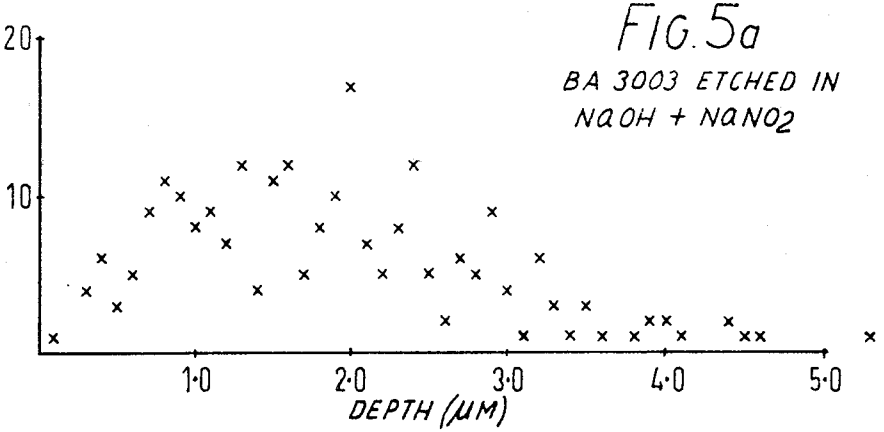
Figure 6A:
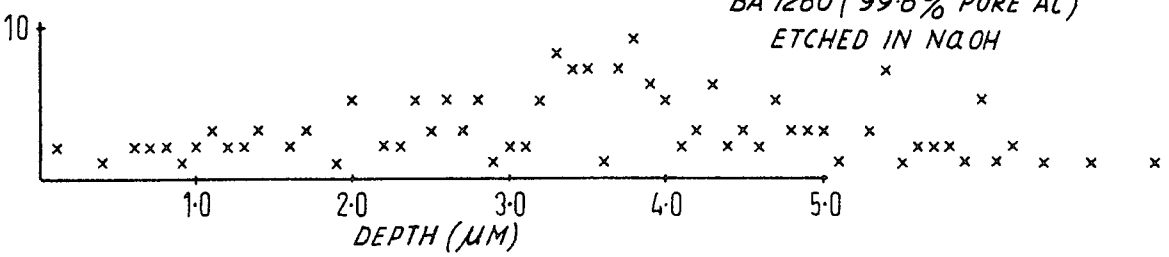
Figure 7B:
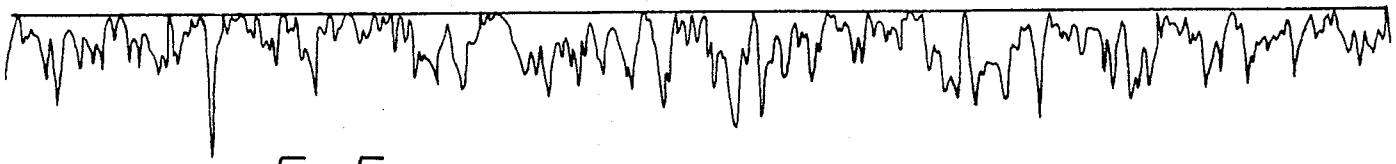
Figure 7B:
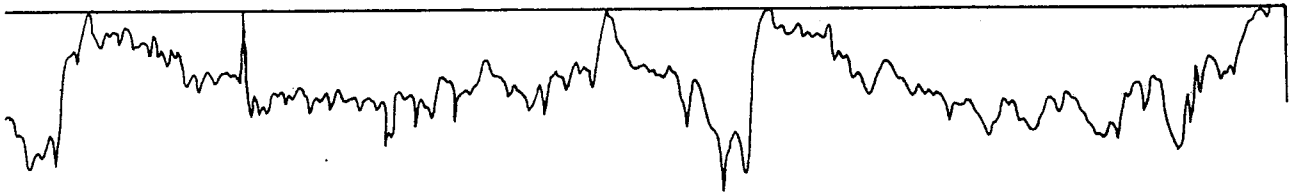
Figure 7B:
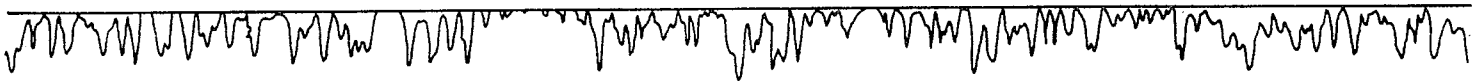
Figure 7A:
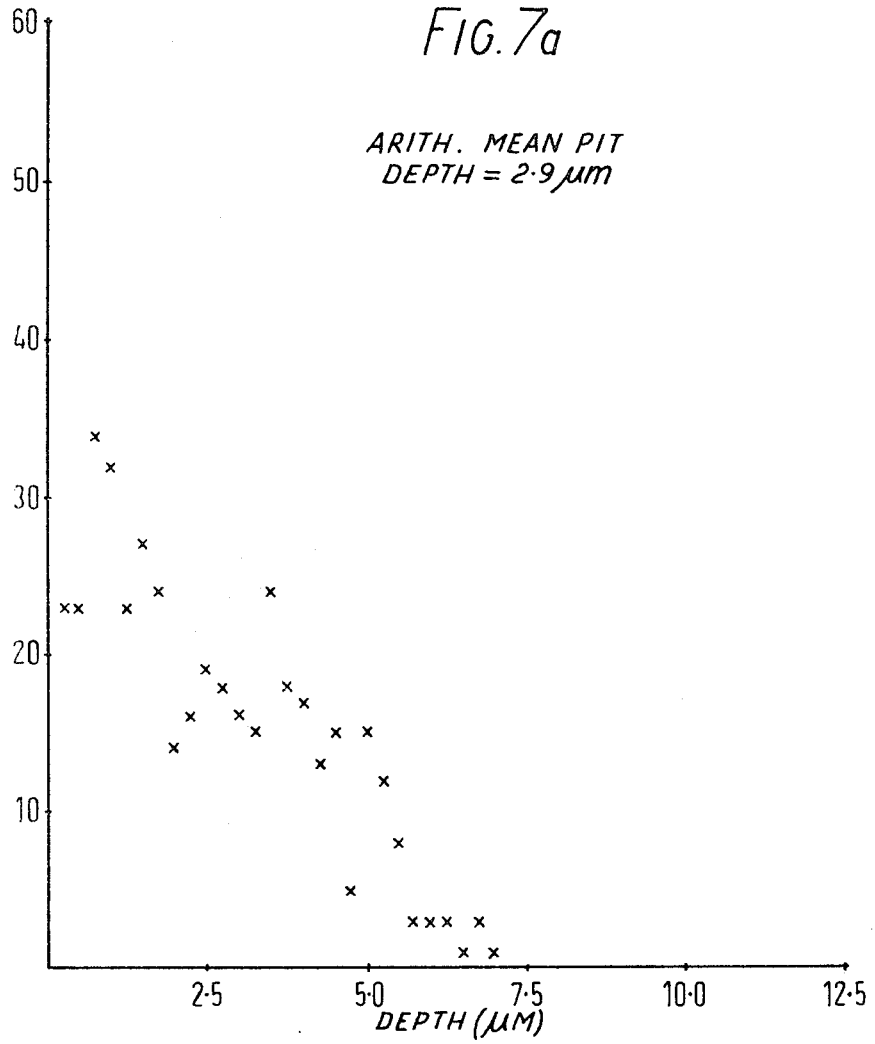

| Alloy | Etch | Mean pit depth | Max. pit depth |
|---|---|---|---|
| A commercial lithoplate FIGS. 7a,7b) of 99.6% pure Al | Electrolytic (HCl) | 2.5 μm | 7.0 μm |
| Al—1% Ca (FIGS. 2a,2b) | Chemical (NaOH) | 0.4 μm | 3-3.5 μm |
| Al—1% CA 1% Zn (FIGS. 1a,1b) | Chemical (NaOH) | 0.5 μm | 3-3.5 μm |
| Al—4.5% Ca (FIGS. 3a,3b) | Chemical (NaOH) | 1.0 μm | 4-4.5 μm |
| Al—1.0% Ca—1.5% Mn | Chemical (NaOH) | 1.0 μm | 3.0 μm |
| BA 3003 (FIGS. 4a,4b) | Chemical (NaOH) | 1.4 μm | 4.5 μm |
| BA 3003 (FIGS. 5a,5b) | Chemical (NaOH & NaNO2) | 1.6 μm | 5.5 μm |
| BA 1260 FIGS. 6a,6b) | Chemical (NaOH) | 3.5 μm | 7.5 μm |

Distribution of pit depths (FIGS. 1*a* to 7*a*)

These graphs are plotted from data obtained from a Talysurf profilometer and processed by computer. The graphs show a plot of pit depth (horizontal axis) against the number of pits with a given depth (vertical axis).

Surface profile traces (FIGS. 1*b* to 7*b*)

These are corrected traces (corrected to remove large undulations in the rolled surface) showing the fineness and density of pitting in cross section. Vertical magnification is ×2000, horizontal magnification is ×100. Thus a good quality finely grained plate has pits with a narrow range of depths around a low mean pit depth as seen in FIGS. 1*a*, 1*b* and 2*a*, 2*b*. The commercial plate surface shown (FIG. 7*a*, 7*b*) is from a fairly coarsely grained plate and is typical of a commercial electrolytic etch in hydrochloric acid.

Figure 8:
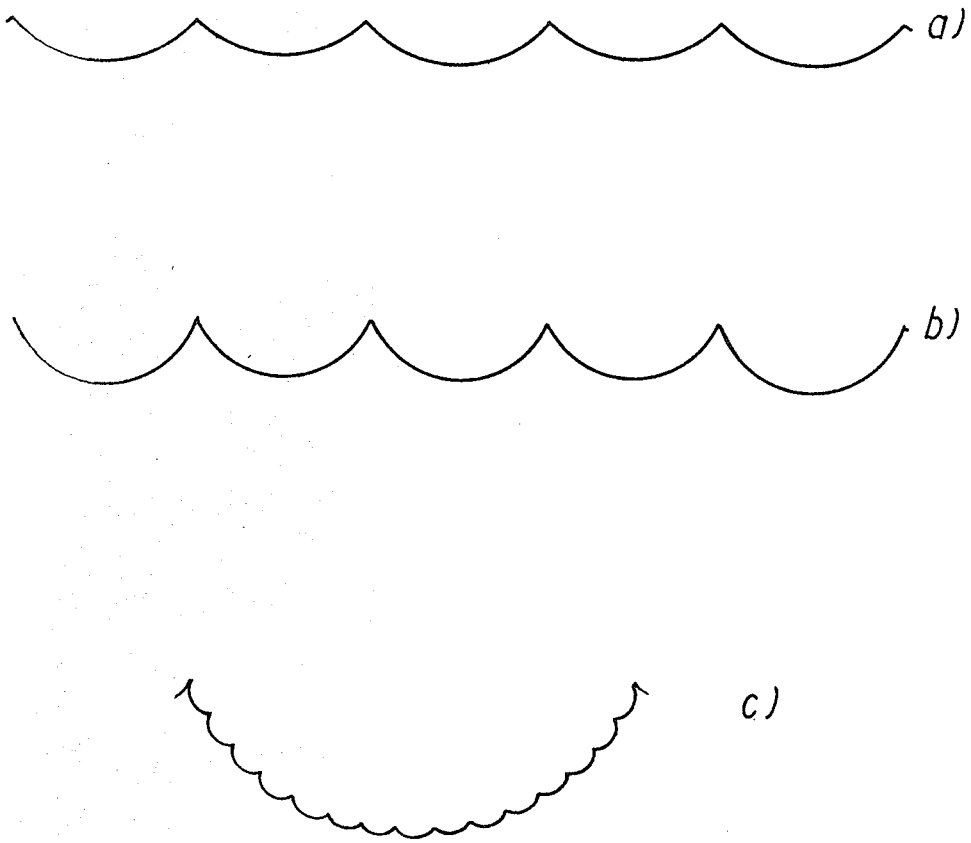

FIG. 8 is a schematic diagram of etches found after treatment with an alkaline solution on (a) Al-1% Ca alloy (b) Al-1% Ca-1.5% Mn alloy showing relatively deeper pits than in (a)

(c) Al-1% Ca - 1.5% Mn alloy enlarged pit to show microroughening with fine pits having a mean depth of approximately 0.1 μm and a maximum depth of approximately 0.3 μm.

It has been found that the inclusion of Fe; Si; or Cu increases the strength of the plate but provides coarser graining while the inclusion of Mn provides both increased strength and fine grain.

It will also be understood that plates produced from the alloys set out above may be grained electrolytically.

I claim:

1. A method of making a lithographic plate from an aluminium base alloy containing 0.1% to 4.5% Ca together with normal impurities comprising subjecting at least one side of the plate to an alkaline etching process in a solution selected from sodium hydroxide and a solution produced by dissolving in water the hydroxides of alkaline metals or ammonia until a dense substantially uniform distribution of pits having an average depth ranging between 0.2 μm and 3.0 μm is formed on said one side.

2. A method according to claim 1 in which the concentration of the solution is between 20 and 270 g/l.

3. A method according to claim 2 in which the concentration is 20–100 g/l.

4. A method according to claim 1 in which the etching temperature is between 15° C. and 100° C.

5. A method according to claim 4 in which the temperature is between 40° C. and 80° C.

6. A method according to claim 1 in which application of the etching solution is by immersion of the alloy in the solution.

7. A method according to claim 1 in which application of the etching solution is by spraying.

8. A method according to claim 1 in which the etching solution contains an oxidising agent selected from alkali metal peroxides, persulphates, nitrites, nitrates, chlorates, perchlorates and chlorites.

9. A method according to claim 1 in which alkaline metal fluorides are added to the etching solution.

10. A method according to claim 1 in which the etching solution contains sequestrants selected from salts of polyhydroxy carboxylic acids such as sodium gluconate sorbitol or EDTA.

* * * * *